US005304049A

United States Patent [19]

Lew

[11] Patent Number: 5,304,049

[45] Date of Patent: Apr. 19, 1994

[54] FRICTIONLESS ROTARY PUMP-MOTOR-METER

[76] Inventor: Hyok S. Lew, 7890 Oak St., Arvada, Colo. 80005

[21] Appl. No.: 531,853

[22] Filed: Jun. 1, 1990

Related U.S. Application Data

[63] Continuation-in-part of Ser. No. 375,466, Jul. 5, 1989, Pat. No. 5,051,078.

[51] Int. Cl.[5] ..... F01C 1/44; G01F 3/08

[52] U.S. Cl. ..... 418/257; 418/264; 418/265; 73/260

[58] Field of Search ..... 418/2, 260, 262, 263, 418/264, 268, 269, 256, 257, 265; 73/260

[56] References Cited

U.S. PATENT DOCUMENTS

| | | | |
|---|---|---|---|
| 3,114,324 | 12/1963 | Baker | 418/264 |
| 3,373,723 | 3/1968 | Blosser | 418/265 X |
| 4,133,618 | 1/1979 | Smolinski | 418/263 |
| 4,149,833 | 4/1979 | Baudin | 418/265 X |
| 4,212,603 | 7/1980 | Smolinski | 418/265 X |
| 4,299,546 | 11/1981 | Stout | 418/263 |
| 4,451,215 | 5/1984 | Winkler et al. | 418/260 X |
| 4,502,853 | 3/1985 | Ohi | 418/2 |
| 4,646,568 | 3/1987 | Lew | 418/268 X |
| 4,765,185 | 8/1988 | Lew | 418/268 X |
| 4,917,584 | 4/1990 | Sakamaki et al. | 418/256 X |

FOREIGN PATENT DOCUMENTS

| | | | |
|---|---|---|---|
| 640856 | 7/1928 | France | 418/265 |
| 2188678 | 10/1987 | United Kingdom | 418/268 |

*Primary Examiner*—John J. Vrablik

[57] ABSTRACT

A rotary pump-motor-meter comprises a rotor assembly including a shaft (38) and one or more hub members (37) coaxially affixed to the shaft, that supports a plurality of flaps (40) disposed about the shaft (38), each of which flaps has a round first edge and a crescent trailing edge and is supported by the hub member (37) pivotably about a pivot axis coinciding with the center of the round first edge disposed adjacent to the shaft (38), which rotor assembly is rotatably disposed within a cylindrical cavity with two port openings in a parallel and eccentric relationship, wherein one or more circular cam guides disposed adjacent to the rotor assembly in a rotable arrangement about a cam axis guides a plurality of cam rollers (41), each of which cam rollers is anchored to one end face of the flaps (40).

18 Claims, 4 Drawing Sheets

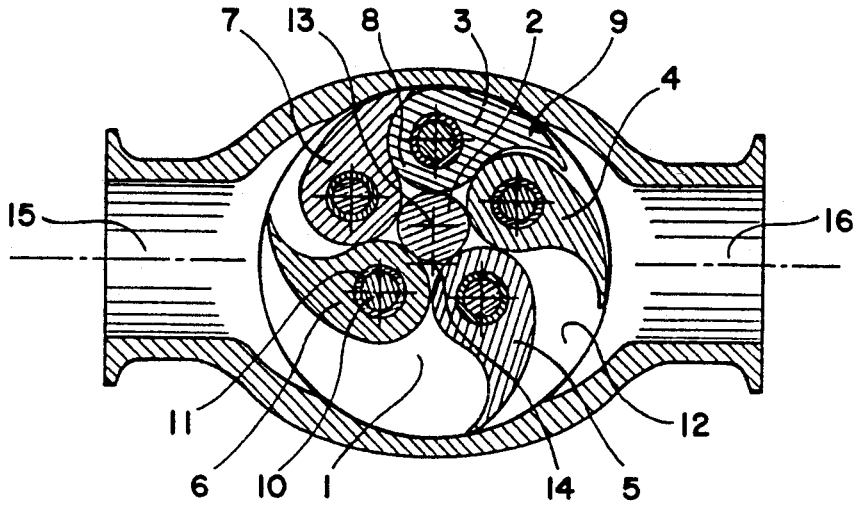
Fig. 1
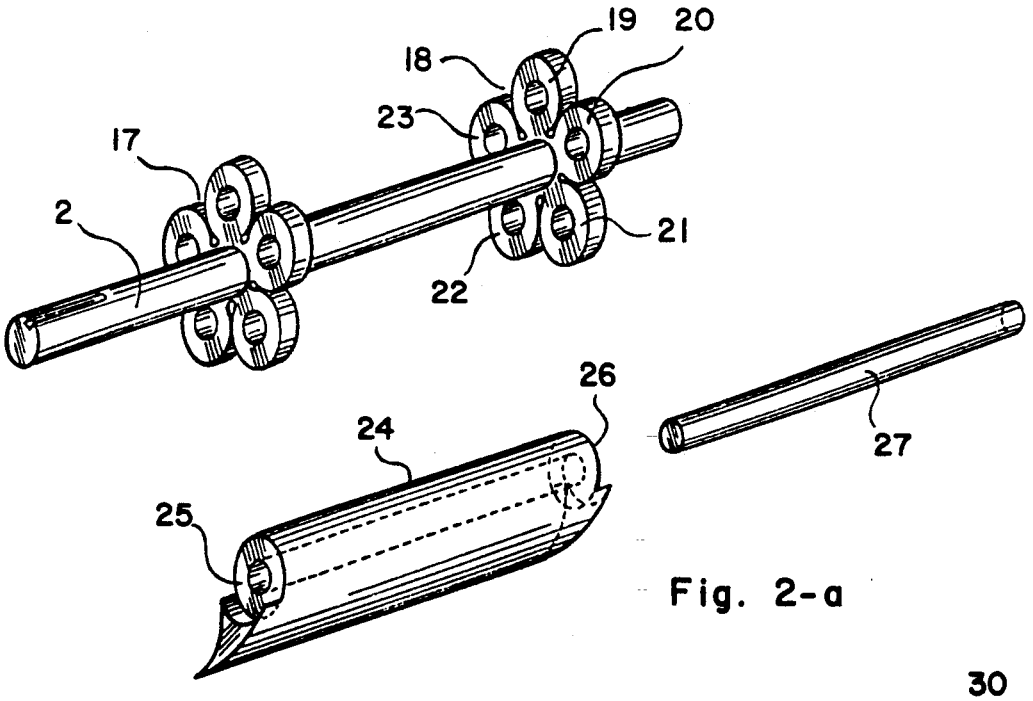
Fig. 2-a
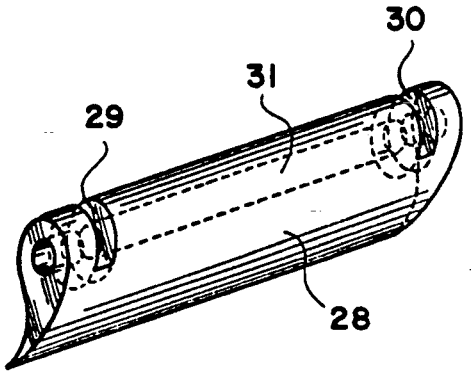
Fig. 2-b

FRICTIONLESS ROTARY PUMP-MOTOR-METER

This patent specification is a continuation-in-part to patent application Ser. No. 07/375,466 entitled "Rotary Pump-Flowmeter" filed on Jul. 5, 1989, U.S. Pat. No. 5,051,078.

There is a great deal of demand in numerous industrial and domestic applications for a fine positive of semi-positive displacement fluid moving apparatus, which is efficient, long-lasting and inexpensive. The simplest and most widely used positive displacement fluid moving apparatus operates on the principle of reciprocating motion as in the case of a piston, plunger or diaphragm pump. The reciprocating motion type positive displacement fluid moving apparatus are not ideal for moving large volumes of fluid at a high speed. One of the better known positive fluid moving apparatus capable of handling a high volume flow of fluid is the sliding vane pump, which operates on principles of combined rotating and reciprocating motions. In numerous occasions through at the history of industrial civilization, many land-mark advancements have been accomplished in the design and construction of industrial equipments by converting the principles of reciprocating motion to the principles of rotating motion. This invention deals with a positive or semi-positive displacement pump and/or motor and/or meter operating on the principles of rotary motion.

The primary object of the present invention is to provide an all rotary motion positive or semi-positive displacement fluid handling apparatus comprising a rotor including an axisymmetric assembly of flaps with a cross section having a round first edge and a crescent second edge disposed about the axis of rotation of the rotor, and one or more hub members of a shaft disposed coaxially to the axis of rotation of the rotor and supporting the flaps in a pivotable arrangement about their respective pivot axes coinciding with the centers of radius of the round first edges of the flaps, wherein the round first edges of the flaps distributed with little spacing therebetween provides a barrier against fluid movement thereacross, which rotor is rotatably disposed within a cylindrical cavity in an eccentric arrangement, wherein rotating motion of the rotor produces pivoting motion of the flaps and the crescent second edges glide on the circular cylindrical surface of the cylindrical cavity. The two opposite halves of the cylindrical cavity respectively disposed on two opposite sides of a plane including the axis of rotation of the rotor and the geometric central axis of the cylindrical cavity respectively include an inlet and outlet ports extending through the wall of the cylindrical cavity.

Another object is to provide one or more circular cam guides guiding cam flollowers included in the flaps, which cam followers and guide control the contact between the second crescent edges of the flaps and the cylindrical wall of the cylindrical cavity.

A further object is to provide a circular cam guide rotating with the orbiting motion of the cam followers.

Yet another object is to provide a circular cam guide comprising a plurality of arcuately elongated openings included in a rotating disc in an axisymmetrical relationship about the central axis of the circular cam guide, wherein each of the arcuately elongated openings receives and guides at least one of the cam followers included in the flaps.

Yet a further object is to provide a hub member coaxially affixed to the rotor shaft having a plurality of lobes, each of which lobes pivotably supports the round first edge of the individual flap.

These and other objects of the present invention will become clear as the description thereof progresses.

The present invention may be described with a greater clarity and specificity by referring to the following figures:

FIG. 1 illustrates a cross section of an embodiment of the fluid handling apparatus of the present invention showing the general arrangement thereof.

FIG. 2-*a* illustrates a perspective view of the shaft with hub members and the flap with pivot pin, which constitute the rotor assembly of the fluid handling apparatus of the present invention.

FIG. 2-*b* illustrates another embodiment of the flap which cam be employed in place of the flap shown in FIG. 2-*a*.

Figure 3:
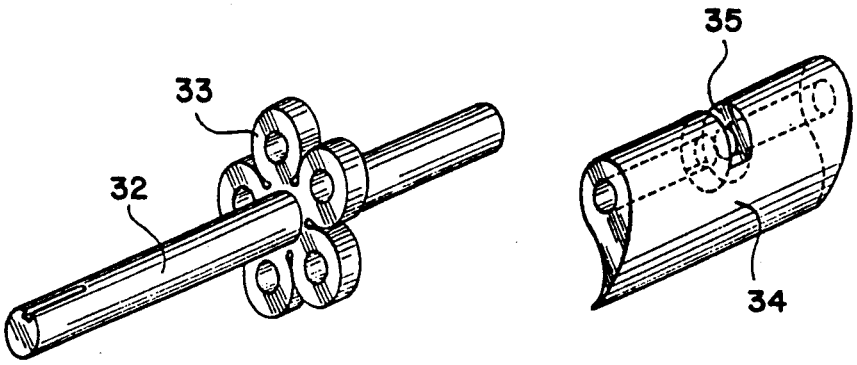
FIG. 3 illustrates a perspective view of the shaft and flap constituting another embodiment of the rotor assembly.

In FIG. 1 there is illustrated a cross section of an embodiment of the pump-motor-meter constructed in accordance with the principles of the present invention. The rotor assembly 1 comprises a shaft 2 and a plurality of flaps 3, 4, 5, 6, 7, etc. disposed about the shaft in an axisymmetric arrangement. The cross section of the individual flap has a shape resembling the Yin-Yang symbol that has a round first edge 8 and a crescent second edge 9. The individual flap is supported by one or more hub members (not shown in FIG. 1 and shown in FIGS. 2, 3 and 4) coaxially affixed to the shaft 2 in a pivotable arrangement about a pivot axis parallel to the shaft and coinciding with the center of radius of the round first edge of the individual flap by means of a pivot pin or journal 10 engaging a bearing 11. The cylindrical circumference of the rotor assembly 1 takes a shape resembling a circular cylindrical surface when all flaps are fully folded towards the shaft 2. The rotor assembly 1 is disposed rotatively within a cylindrical cavity 12 in a parallel and eccentric relationship. The two opposite halves of the cylindrical cavity 12 disposed on two opposite sides of a plane including the central axis 13 of the shaft 2 and the geometric central axis 14 of the cylindrical cavity 12 respectively include a first and second port openings 15 and 16 extending through the cylindrical wall of the cavity 12 as shown in the particular illustrative embodiment or through one or both end walls of the cavity 12 in an alternative embodiment that is not shown. The round first edges of the flaps are disposed axisymmetrically about the shaft 2 with little spacing between the round first edges and, consequently, the combination of the round first edges of the flaps provides a barrier seal against fluid flow thereacross. The spacing between the shaft 2 and the round first edges of the flaps may have little clearance, whereby a secondary barrier seal backing up the primary barrier seal provided by the round first edges of the flaps is realized. The folding and unfolding movements of the flaps resulting from the pivoting motions thereof about respective pivot axes are controlled by a combination of cam followers and guides as shown in FIGS. 5 through 14 in such a way that the convex surface or the crescent second edges of the flaps glide on the inner cylindrical surface of the cavity 12. The rotor assembly 1 may be rotated in a clockwise or counter clockwise direction depending on the application and operating condition of the fluid handling apparatus. It is readily recognized that the shaft 2 does not require a rotary seal in applications such as the supercharger of an internal combustion engine, where a minute amount of fluid leak through the shaft bearing does not create any detrimental result. The number of flaps included in the rotor assembly 1 may vary from three to any high number. In handling fluid medium bearing particles of finite size, the eccentricity between the central axis 13 of the shaft 2 and the geometric central axis 14 of the cylindrical cavity 12 may be set in such a way that the round first edges of the flaps are always separated from the inner cylindrical wall of the cavity 12 and the cam guide includes only the outer guide surface that prevents the crescent second edges of the flaps from scraping the inner cylindrical wall of the cavity 12 while allowing the crescent second edges of the flaps to be lifted away from the inner cylindrical wall of the cavity when particles in the fluid get trapped therebetween. In such an application, the rotor assembly 1 shown in FIG. 1 should be rotated in a counter clockwise direction, wherein the centrifugal force of the flaps keeps the flaps at a properly extended position while the cam guide prevents the crescent edges of the flaps from scraping the cylindrical wall of the cavity 12.

In FIGS. 2-*a* and *b* there is illustrated a perspective view of the shaft and one of the plurality of flaps constituting the rotor assembly 1 shown in FIG. 1. The shaft 1 has one or more hub members 17 and 18 of lobed construction that includes a plurality of lobes 19, 20, 21, 22, 23, etc. axisymmetrically distributed about the shaft 2. A first embodiment (FIG. 2-*a*) of the individual flap 24 assembled to the shaft 2 has the round first edge portions of the two extremities thereof stepped down from the second crescent edge portions, which arrangement provides a pair of depressed seats 25 and 26, each of which receives a lobe included in the hub members 17 or 18 in a close tolerance relationship. The pin or journal 27 pivotably secures the flap 26 to the hub members 17 and 18. The rotor assembly including the shaft 2 and the flaps 26 takes a circular cylindrical shape with two flat ends, when all flaps are fully folded towards the shaft. It should be mentioned that the lobe included in the hub member 17 or 18 must engage the depressed seat 25 or 26 in such a way that there is little spacing between the cylindrical surfaces thereof in order to prevent fluid leak across the flap in the rotor assembly. A second embodiment (FIG. 2-*b*) of the flaps 28 assembled to the shaft 2 includes cut-outs 29 and 30 extending through the first round edge 31 of the flap, each of which cut-outs 29 and 30 receives a lobe included in the hub member 17 or 18 in a close tolerance relationship. The cylindrical surfaces included in the lobes and cut-outs must mate with little space therebetween in order to prevent the leak across the flap in the rotor assembly, which condition dictates that the cylindrical surfaces included in the depressed seats 25 and 26, and those in cut-outs 29 and 30 as well as those of lobes included in the hub members 17 and 18 must be a circular cylindrical surface. It is readily recognized that the rotor assembly including the shaft 2 and the flaps 28 also takes a circular cylindrical shape with two flat ends when all the flaps are fully folded towards the shaft 2.

In FIG. 3 there is illustrated a perspective view of another embodiment of elements constituting the rotor assembly. The shaft 32 has a single hub member 33 including a plurality of lobes. The flap 34 has a single pocket 35 receiving a lobe included in the hub-member 33 in a close tolerance as described in conjunction with FIG. 2.

Figure 4:
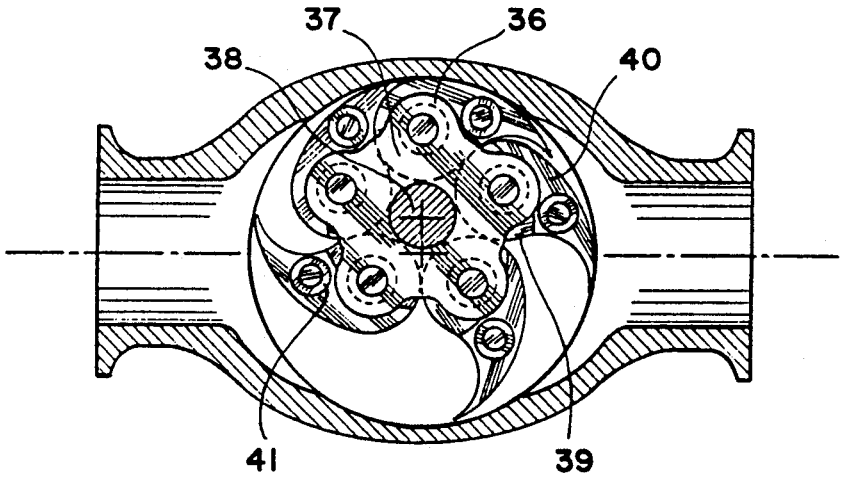
FIG. 4 illustrates a further embodiment of the rotor assembly.

In FIG. 4 there is illustrated a cross section of the fluid handling apparatus of the present invention comprising a further embodiment of the rotor assembly. The pluralities of lobes included in the hub member 37 of the shaft 38 has a radius smaller than the radius of the round first edge of the flap, while the lobes included in the hub members shown in FIGS. 2 and 3 have a radius matched to the radius of the round first edge of the flap. The depressed seat 39 equivalent to elements 25 and 26 in FIG. 2-*a* or cut-outs 29 and 30 in FIG. 2-*b* shown in FIG. 4, included in each of the flaps 40 has a circular cylindrical portion establishing a sliding relationship with the circular cylindrical edge surface of the lobe 36. It is self-evident that one or more hub-members 37 of the particular construction may be included in a single shaft as demonstrated by the embodiments shown in FIGS. 2 and 3. The reason for the use of the hub member of lobed construction is to expose a substantial portion of one or both end faces of the flaps, whereby at least one cam roller 41 with roller axis parallel to the shaft 38 can be affixed to at least one end face of the flap, which reason becomes self-evident from the cross section of the rotor assembly shown in FIG. 4.

Figure 5:
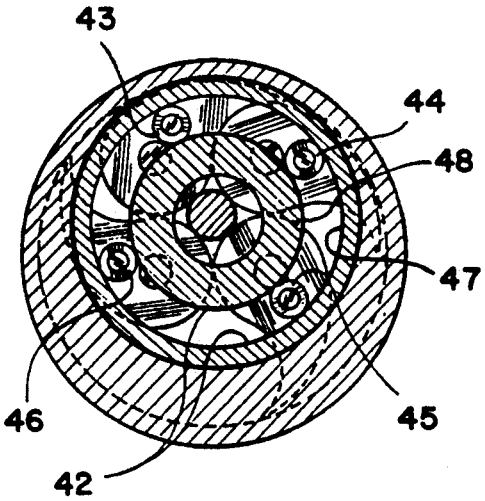
FIG. 5 illustrates an embodiment of the circular cam guide guiding the cam followers included in the flaps.

In FIG. 5 there is illustrated a cross section of a fluid handling apparatus of the present invention showing a circular cam guide 42 guiding a plurality of cam followers 43, 44, 45, 46, etc., each of which is affixed to one end face of the plurality of flaps in an off-set relationship to the pivot axis of the flap. In this particular embodiment, the roller axis of the cam follower is located on the second crescent edge side from the pivot axis of the flap. While the circular cam guide 42 employed in the particular illustrative embodiment has both an outer cam guide surface 47 and an inner cam guide surface 48, an alternative design may inlcude only the outer or inner cam guide surface.

Figure 6:
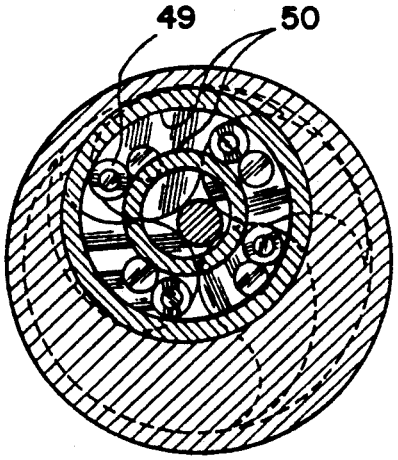
FIG. 6 illustrates another embodiment of the circular cam guide guiding the cam followers included in the flaps.

In FIG. 6 there is illustrated another embodiment of the combination of the plurality of cam followers 49 and the circular cam guide 50, wherein the cam follower is located on the round first edge side from the pivot axis of the flap. In general, the circular cam guide 50 may include both or one of the outer and inner cam guide surfaces as mentioned in conjunction with FIG. 5.

Figure 7:
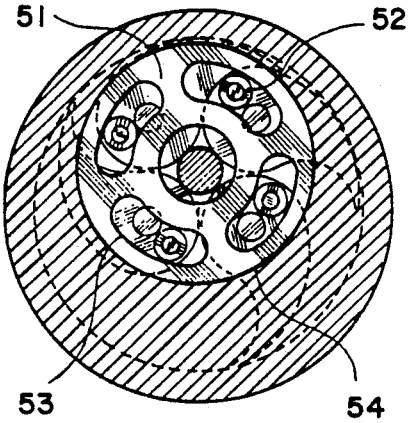
FIG. 7 illustrates a further embodiment of the circular cam guide guiding the cam followers included in the flaps.

In FIG. 7 there is illustrated a further embodiment of the circular cam guide that guides the cam rollers 52 located on the round first edge sides of the flaps, which circular cam guide includes a plurality of arcuately elongated openings or pockets 53 included in a circular rotary member 54 in an axisymmetric arrangement, wherein each of the arcuately elongated openings or pockets is engaged by each of the cam followers.

Figure 8:
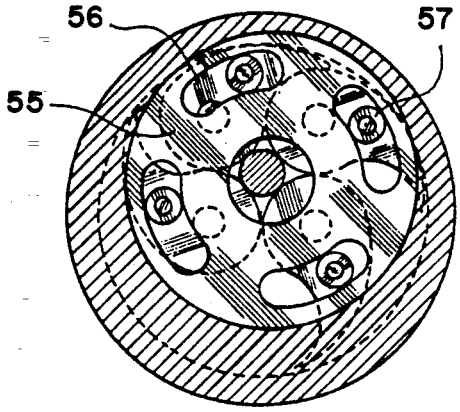
FIG. 8 illustrates yet another embodiment of the circular cam guide guiding the cam followers included in the flaps.

In FIG. 8 there is illustrated yet another embodiment of the circular cam guide disc 55 having a plurality of arcuately elongated openings or pockets 56 disposed in an axisymmetric arrangement, each of which arcuately elongated openings or pockets is engaged by each of the cam followers 57 located on the crescent second edge of the flap. It should be mentioned that the cam guide discs shown in FIGS. 5 and 6 may be nonrotatably affixed to the wall of the cylindrical cavity housing the rotor assembly or rotatably floated or rotatably supported thereby, wherein the rotatably floated or supported cam guide disc is rotated by the friction force exerted by the orbiting motions of cam followers, while the cam guide discs shown in FIGS. 7 and 8, which may be rotatably floated or rotatably supported by the wall of the cylindrical cavity, is positively driven by the orbiting motion of cam followers.

Figure 9:
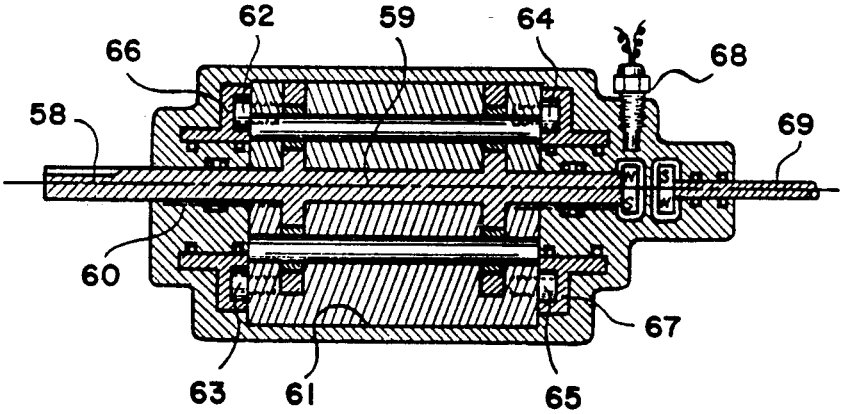
FIG. 9 illustrates a cross section of an embodiment of the fluid handling apparatus of the present invention.

In FIG. 9 there is illustrated a cross section of an embodiment of the fluid handling apparatus of the present invention, which cross section is taken along a plane including the central axis 58 of the rotor shaft 59 and the geometrical central axis 60 of the cylindrical cavity 61. The rotor assembly of this particular embodiment comprises the type of shaft 2 and the type of flap 28 shown in FIG. 1, which shaft extends through at least one end wall of the cylindrical cavity 61. The cam followers 62, 63, 64, 65, etc. anchored to the two end faces of the flaps are guided by a pair of rotating circular cam guides 66 and 67 rotatably supported by the body of the cylindrical cavity 61, which circular cam guides are of the type shown in FIG. 5 or 6. It is readily realized that the type of circular cam guides shown in FIG. 7 or 8 may be employed in place of the elements 66 and 67. The electronic transducer 68 or mechanical counter 69 measures the speed of rotation of the rotor assembly as a measure of volume flow rate of fluid moving through the apparatus. The extremity of the shaft 59 extending out of the end wall of the cylindrical cavity must have a means such as a pulley or gear that transmits power thereof or therefrom. When the apparatus is used as a flowmeter, the shaft 59 should not extend through the end wall of the cylindrical cavity, which eliminates the need for a rotary seal installed on the shaft.

Figure 10:
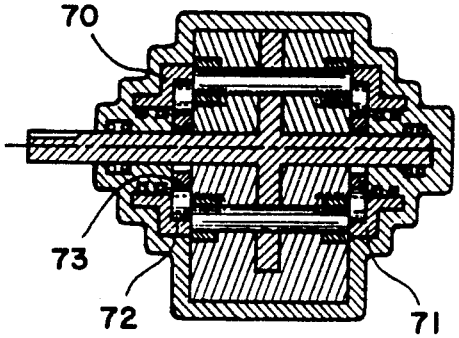
FIG. 10 illustrates a cross section of another embodiment of the fluid handling apparatus of the present invention.

In FIG. 10 there is illustrated a cross section of another embodiment of the fluid handling apparatus of the present invention having essentially the same elements and the same construction as the embodiment shown in FIG. 9 with a few exceptions. The rotor assembly employed in this embodiment comprises the type of shaft 32 and the type of flaps 34 shown in FIG. 3. The circular cam guides 70 and 71 have a construction slightly different from those included in the embodiment shown in FIG. 9. The outer cam guide 72 is rotatably supported by the body of the cylindrical cavity housing the rotor assembly, while the inner cam guide 73 is floated and kept in position by the cam followers acting like bearings intermediate the outer and inner cam guides 72 and 73. Of course, the type of circular cam guide shown in FIG. 7 or 8 can be readily incorporated into the fluid handling apparatus shown in FIG. 10. It should be mentioned that the embodiments shown in FIGS. 9 and 10 may include one combination of the circular cam guide and cam followers disposed on one side of the rotor assembly instead of the pair of combinations shown and described.

Figure 11:
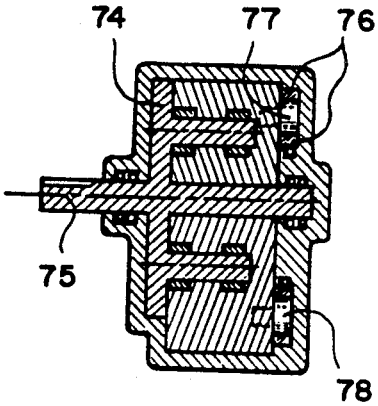
FIG. 11 illustrates a cross section of a further embodiment of the fluid handling apparatus of the present invention.

In FIG. 11 there is illustrated a cross section of a further embodiment of the fluid handling apparatus that includes a hub member 74 of simple circular shape affixed to the shaft 75 and supporting the flaps with a cross section of the Yin-Yang shape. A circular cam guide 76 of the type shown in FIG. 7 or 8 rotatably supported by the body 77 of the cylindrical cavity guides the cam followers 77, 78, etc. anchored to the end faces of the flaps opposite to the end faces thereof adjacent to the circular hub member 74. This particular embodiment is ideal when the apparatus is exclusively used as a flowmeter because of the simple and inexpensive construction. The type of hub member 17 and the flaps having one half of the type of flap 24 shown in FIG. 2 may be employed to construct a rotor assembly which can substitute for the type of rotor assembly shown in FIG. 11. The circular cam guide 76 may be substituted by a pair of circular cylindrical rings respectively working as the outer and inner cam guides. It should be mentioned that the circular cam guides employed in the embodiments shown in FIGS. 9, 10 and 11 may include only one of the outer or inner cam guides instead of the combination including both.

Figure 12:
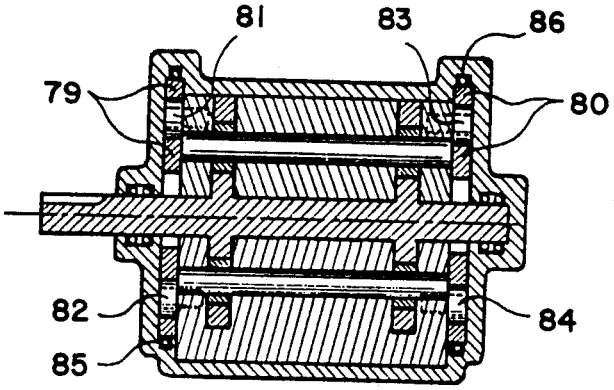
FIG. 12 illustrates a cross section of yet another embodiment of the fluid handling apparatus of the present invention.

In FIG. 12 there is illustrated a cross section of yet another embodiment of the fluid handling apparatus of the present invention, that includes a pair of circular cam guides 79 and 80 of the type shown in FIG. 7 or 8, or the type comprising physically separated outer and inner cam guides, which circular cam guides are either floated and supported by the cam followers 81, 82, 83, 84, etc., or rotatably supported by the body of the cylindrical cavity housing the rotor assembly by means of the spherical or roller bearings 85 and 86 disposed along the outer circular perimeters thereof.

Figure 13:
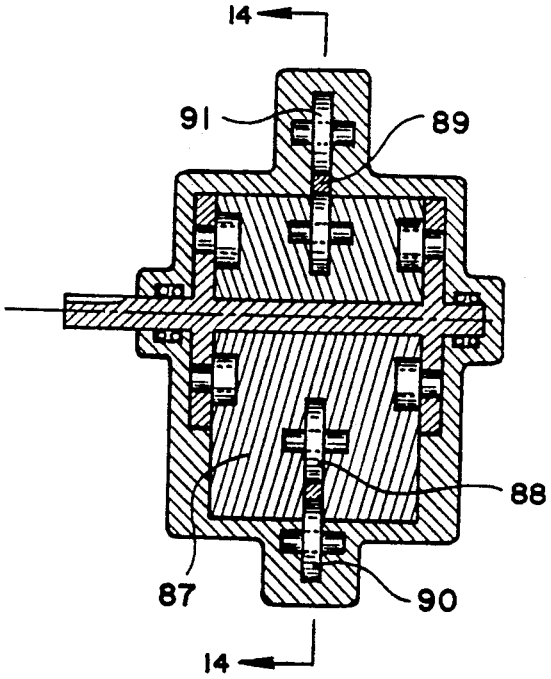
FIG. 13 illustrates a cross section of yet a further embodiment of the fluid handling apparatus of the present invention.

In FIG. 13 there is illustrated a cross section of yet a further embodiment of the fluid handling apparatus of the present invention, wherein the individual flap 87 includes a cam follower or roller 88 disposed in a cut-out included in a midsection of the flap and extending through the crescent second edge of the flap, which cam follower or roller 88 is guided by a circular cam guide 89 that may be stationary or rotatably supported by a plurality of rollers 90, 91, etc. anchored to the body of the cylindrical cavity housing the rotor assembly.

Figure 14:
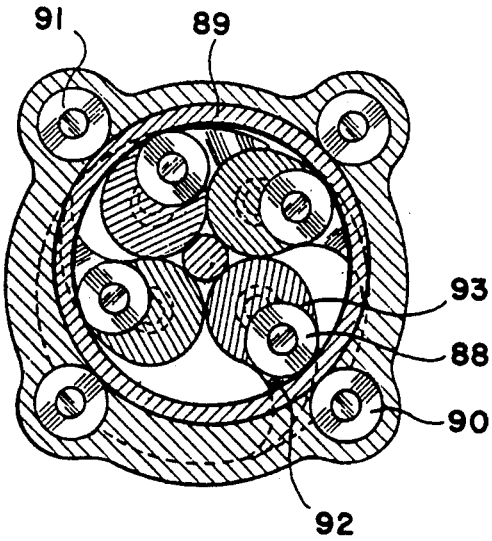
FIG. 14 illustrates another cross section of the embodiment shown in FIG. 13.

In FIG. 14 there is illustrated another cross section of the embodiment shown in FIG. 13, which cross section is taken along plane 14—4 as shown in FIG. 13. The cut-outs 92 receiving the cam followers or rollers 88 have a circular bottom 93 that is under a slidable contact with the circular cylindrical surface of the rollers so that the little fluid can leak across the flap. In this particular embodiment, the hub members supporting the flaps in a pivotable arrangement may have a simple circular shape or a lobed shape as described in conjunction with FIG. 11. It should be mentioned that the shaft extending through one end wall of the cylindrical cavity housing the rotor assembly must have a rotary seal unless a minor leak of the fluid following the extending shaft is acceptable.

While the principles of the present invention have not been made clear by the illustrative embodiments, there will be many modifications of the structures, arrangements, proportions, elements and materials obvious to those skilled in the art, which are particularly adapted to the specific working environments and operating conditions in the practice of the inventions without departing from those principles. It is not desired to limit the inventions to the particular illustrative embodiments shown and describe and, accordingly, all suitable modifications and equivalents may be regarded as falling within the scope of the inventions as defined by the claims which follow.

The embodiments of the invention, in which an exclusive property or privilege is claimed, are defined as follows:

1. An apparatus for handling fluid comprising in combination:

a) a body including a cylindrical cavity having a smooth cylindrical wall;

b) a rotor assembly including a shaft with at least one hub member and a plurality of flaps disposed about the shaft, each of the plurality of flaps having a cross section including a round first edge disposed adjacent to the shaft and a crescent second edge, and supported by said at least one hub member in a pivotable arrangement about each of a plurality of pivot axes disposed parallel to and about the shaft in an axisymmetric arrangement and coinciding with the center of radius of the round first edge thereof, wherein the round first edges belonging to adjacent flaps of said plurality of flaps are disposed in a closely adjacent relationship therebetween in an arrangement substantially free of any extensions of rotary members supported by the shaft extending radially from said shaft and extending into and through space between the round first edges belonging to the adjacent flaps, said rotor assembly disposed within said cylindrical cavity in a parallel and eccentric relationship in a rotatable arrangement about the central axis of said shaft;

c) at least one rotary cam guide of a circular geometry disposed on a plane substantially perpendicular to the shaft in a rotatable arrangement about a cam axis parallel and eccentric to said shaft and to the geometrical central axis of said cylindrical cavity, said rotary cam guide guiding a plurality of cam followers following a circular path coaxial to said cam axis, wherein at least one each of the plurality of cam followers is secured to each of said plurality of flaps in an off-set relationship to the pivot axis of said one each of the plurality of flaps in such a way that the second crescent edges of said plurality of flap slide on the cylindrical wall of said cylindrical cavity under a controlled pressure therebetween; and d) a first and second port openings respectively open to two opposite halves of said cylindrical cavity respectively located on two opposite sides of a hypothetical plane generally including the central axis of said shaft and the geometrical central axis of said cylindrical cavity.

2. A combination as set forth in claim 1 wherein the round first edges of said plurality of flaps are disposed at close proximities to the cylindrical surface of said shaft with little space therebetween.

3. A combination as set forth in claim 1 wherein the combination of said at least one rotary cam guide and said plurality of cam followers positively controls pivoting movements of the crescent second edges of said plurality of flaps about respective pivot axis thereof in at least one of two radial directions away from and towards the shaft.

4. A combination as set forth in claim 1 wherein said rotary cam guide includes at leas one continuous circular guide surface coaxial to said cam axis and rotatably supported by said body.

5. A combination as set forth in claim 1 wherein said rotary cam guide includes a plurality of discrete arcuate guides disposed on a circle coaxial to said cam axis and rotatably supported by said body, wherein each of the plurality of discrete arcuate guides is enlarged by at least one of the plurality of cam followers.

6. A combination as set forth in claim 1 wherein said at least one rotary cam guide is disposed adjacent to one end face of said rotor assembly and said plurality of cam followers are secured to end faces of said plurality of flaps forming a portion of said one end face of the rotor assembly.

7. A combination as set forth in claim 1 wherein said shaft includes means for transmitting a rotating motion thereto and therefrom.

8. A combination as set forth in claim 1 wherein said combination includes means for measuring the speed of rotation of said rotor assembly.

9. An apparatus for handling fluid comprising in combination:

a) a body including a cylindrical cavity having a smooth cylindrical wall;

b) a rotor assembly including a shaft with at least one hub member of lobed construction including a plurality of lobes disposed axisymmetrically about said shaft and a plurality of flaps disposed about the shaft, each of the plurality of flaps having a cross section including a round first edge disposed adjacent to the shaft and a crescent second edge wherein said round first edge includes an open cavity receiving each of said plurality of lobes in a close tolerance relationship, said each of the plurality of flaps supported by said each of plurality of lobes in a pivotable arrangement about each of a plurality of pivot axes disposed parallel to and about the shaft in an axisymmetric arrangement and coinciding with the center of radius of the round first edge thereof, wherein the round first edges belonging to adjacent flaps of said plurality of flaps are disposed with little space therebetween in an arrangement substantially free of any extensions of the shaft extending radially from said shaft and extending into and through said little space between the round first edges belonging to the adjacent flaps, said rotor assembly disposed within said cylindrical cavity in a parallel and eccentric relationship in a rotatable arrangement about the central axis of said shaft;

c) at least one rotary cam guide of a circular geometry disposed on a plane substantially perpendicular to the shaft in a rotatable arrangement about a cam axis parallel and eccentric to said shaft and to the geometrical center axis of said cylindrical cavity, said rotary cam guide guiding a plurality of cam followers following a circular path coaxial to said cam axis, wherein at least one each of the plurality of cam followers is secured to each of said plurality of flaps in an off-set relationship to the pivot axis of said one each of the plurality of flaps in such a way that the crescent second edge of said plurality of flaps slide on the cylindrical wall of said cylindrical cavity under a controlled pressure therebetween; and d) a first and second port openings respectively open to two opposite halves of said cylindrical cavity respectively located on two opposite sides of a hypothetical plane generally including the central axis of said shaft and the geometrical central axis of said cylindrical cavity.

10. A combination as set forth in claim 9 wherein the round first edges of said plurality of flaps are disposed at close proximities to the cylindrical surface of said shaft with little space therebetween.

11. A combination as set forth in claim 9 wherein the combination of said at least one rotary cam guide and said plurality of cam followers positively controls pivoting movements of the crescent second edges of said plurality of flaps about respective pivot axis thereof in at least one of two radial directions away from and towards the shaft.

12. A combination as set forth in claim 9 wherein said rotary cam guide includes at least one continuous circular guide surface coaxial to said cam axis and rotatably supported by said body.

13. A combination as set forth in claim 9 wherein said rotary cam guide includes a plurality of discrete arcuate guides disposed on a circle coaxial to said cam axis and rotatably supported by said body, wherein each of the plurality of discrete arcuate guides is engaged by at least one of the plurality of cam followers.

14. A combination as set forth in claim 9 wherein said at least one rotary cam guide is disposed adjacent to one end face of said rotor assembly and said plurality of cam followers are secured to end faces of said plurality of flaps forming portion of said one end face of the rotor assembly.

15. A combination as set forth in claim 9 wherein said shaft includes means for transmitting a rotating motion thereto and therefrom.

16. A combination as set forth in claim 9 wherein said combination includes means for measuring the speed of rotation of said rotor assembly.

17. An apparatus for handling fluid comprising in combination:

a) a body including a cylindrical cavity having a smooth cylindrical wall;

b) a rotor assembly including a shaft with at least one hub member and a plurality of flaps disposed about the shaft, each of the plurality of flaps having a cross section including a round first edge disposed adjacent to the shaft and a crescent second edge and supported by said at least one hub member in a pivotable arrangement about each of a plurality of pivot axes disposed parallel to and about the shaft in an axisymmetric arrangement and coinciding with the center of radius of the round firs edge thereof, wherein the round first edges belonging to adjacent flaps of said plurality of flaps are disposed with little space therebetween in an arrangement substantially free of any extensions of the shaft extending radially from said shaft and extending into and through said little space between the round firs edges belonging to the adjacent flaps, said rotor assembly disposed within said cylindrical cavity in a parallel and eccentric relationship in a rotatable arrangement about the central axis of said shaft;

c) at least one rotary cam guide of a circular ring geometry disposed about said rotor assembly intermediate two ends of the rotor assembly on a plane substantially perpendicular to said shaft and supported by said body in a rotatable arrangement about a cam axis parallel and eccentric to said shaft and to the geometrical central axis of said cylindrical cavity, said rotary cam guide guiding a plurality of cam rollers following a circular path coaxial to said cam axis, wherein at least one each of the plurality of cam rollers is disposed in a pocket cut into the crescent second edge of each of the plurality of flaps and secured to the flap in a rotatable arrangement about a cam roller axis parallel to and off-set from the pivot axis of said one each of the plurality of flaps as well as to and from said shaft in such a way that the cam roller rolls on the inside cylindrical surface of said rotary cam guide, and the crescent second edges of the plurality of flaps slide on the cylindrical wall of said cylindrical cavity under a controlled pressure therebetween; and d) a first and second port openings respectively open to two opposite halves of said cylindrical cavity respectively located on two opposite sides of a hypothetical plane generally including the central axis of said shaft and the geometrical central axis of said cylindrical cavity.

18. An apparatus for handling fluid comprising in combination:

a) a body including a cylindrical cavity having a smooth cylindrical wall;

b) a rotor assembly including a shaft with at least one hub member of lobed construction including a plurality of lobes disposed axisymmetrically about said shaft and a plurality of flaps disposed about said shaft, each of the plurality of flaps having a cross section including a round first edge disposed adjacent to the shaft and a crescent second edge wherein said round first edge includes an open cavity receiving each of said plurality of lobes in a close tolerance relationship, said each of the plurality of flaps supported by each of said plurality of lobes in a pivotable arrangement about each of a plurality of pivot axes disposed parallel to and about the shaft in a axisymmetric arrangement and coinciding with the center of radius of the round first edge thereof, wherein the round first edges belonging to adjacent flaps of said plurality of flaps are disposed with little space therebetween in an arrangement substantially free of any extensions of the shaft extending radially from said shaft and extending into and through said little space between the round first edges belonging to the adjacent flaps, said rotor assembly disposed within said cylindrical cavity in a parallel and eccentric relationship in a rotatable arrangement about the central axis of said shaft;

c) at least one rotary cam guide of a circular ring geometry disposed about said rotor assembly intermediate two ends of the rotor assembly on a plane substantially perpendicular to said shaft and supported by said body in a rotatable arrangement about a cam axis parallel and eccentric to said shaft and to the geometrical axis of said cylindrical cavity, said rotary cam guide guiding a plurality of cam rollers following a circular path coaxial to said cam axis, wherein at least one each of the plurality of cam rollers is disposed in a pocket cut into the crescent second edge of each of the plurality of the flaps and secured to the flap in a rotatable arrangement about a cam roller axis parallel to and off-set from the pivot axis of said one each of the plurality of flaps as well as to and from said shaft in such a way that the cam roller rolls on the inside cylindrical surface of said rotary cam guide, and the crescent second edges of the plurality of flaps slide on the cylindrical wall of said cylindrical cavity under a controlled pressure therebetween; and d) a first and second port openings respectively open to two opposite halves of said cylindrical cavity respectively located on two opposite sides of a hypothetical plane generally including the central axis of said shaft and the geometrical central axis of said cylindrical cavity.

* * * * *